United States Patent [19]

Wörder

[11] 4,210,142

[45] Jul. 1, 1980

[54] TWIN CHAMBER INJECTION SYRINGE

[76] Inventor: Hans Wörder, 27, Lange Wand, D-4980 Bünde 1, Fed. Rep. of Germany

[21] Appl. No.: 953,340

[22] Filed: Oct. 20, 1978

[30] Foreign Application Priority Data

Oct. 22, 1977 [DE] Fed. Rep. of Germany ..... 7732670

[51] Int. Cl.[2] ..... A61J 1/00

[52] U.S. Cl. ..... 128/272.1

[58] Field of Search ..... 128/218 M, 218 R, 218 DA, 128/272.1, 272.3, 215, 216, 220, 272; 141/2, 22, 23, 311 R; 215/200, 220, 250

[56] References Cited

U.S. PATENT DOCUMENTS

| | | | |
|---|---|---|---|
| 2,957,501 | 10/1960 | Holmes | 141/2 |
| 3,206,080 | 9/1965 | Scislowicz | 128/215 X |
| 3,330,281 | 7/1967 | Visser | 128/272.1 |
| 3,392,726 | 7/1968 | Pochyla et al. | 128/272 |
| 3,995,630 | 12/1976 | Veerdonk | 128/218 DA |

*Primary Examiner*—John D. Yasko

*Attorney, Agent, or Firm*—William A. Drucker

[57] ABSTRACT

A twin-chamber syringe for medical purposes has a cylindrical syringe body with a conical shoulder on the front end, a peripheral rotating locking ring for firmly mounting a sealing cap or subsequently a tube, a piston that can be displaced by means of a plunger and which seals the syringe body at the rear, and a separate container to be connected to the syringe, as the second chamber, and which has a sealing cap with a flanged cap incorporated in it. The improvement is that the container serving as the second container, and which contains the mixing component, has a resilient locking cap with a central weak point diaphragm, and that the flanged cap has a centering device covering that weak point and receiving the conical shoulder, so that when the container is fitted, the centering device and the peripheral locking ring snap into each other and can be later detached.

10 Claims, 7 Drawing Figures

TWIN CHAMBER INJECTION SYRINGE

The object of the invention relates to a twin chamber syringe in the form of an injection syringe for medical purposes, consisting of a cylindrical syringe body with a conical shoulder inserted or flanged on at the front end, with a rotating locking ring for the firm mounting of a sealing cap or a subsequent tubule, and of a piston which is displaced by means of a plunger and seals the syringe body at the rear, and a separate container, as the second chamber, to be connected to the syringe and exhibiting a locking cap with a flanged cap incorporated.

Such injection syringes are used in human medicine for the administration of dissolved medicines, the injection being given subcutaneously, intramuscularly, intravenously or by other similar means.

Injection syringes, designed as twin chamber syringes, enable two components provided for simultaneous injection to be stored separately, to be mixed and to be extracted simultaneously. At least one of the two components is in liquid form. The dry substance can be freeze dried if necessary.

Thus knowledge has been gained, for example, of a twin chamber syringe which exhibits two chambers, one of which is designed in the form of a syringe. Both chambers are connected by a length of tube that can be twisted. By twisting the tube length the seals of both chambers will push through so that a connection is made which enables the components from the two chambers to be mixed and the mixed liquid to be returned to the section designed as the syringe.

The known injection syringe suffers from the disadvantage of having a very expensive design, particularly with regard to the intermediate section connecting the two chambers. The twisting length of tube also requires high-precision manufacture in a vacuum-tight design.

The principal objective of the invention is to provide a twin chamber injection syringe which is reliable in application and which can be manufactured at reasonable cost, to enable the injection components to be mixed and sucked up by simple means.

Assuming a twin-chamber syringe in the form of an injection syringe for medical purposes, consisting of a cylindrical syringe body with a conical shoulder inserted or flanged on to the front end, with a rotating locking ring for firm mounting of a sealing cap or a subsequent tubule, and of a piston which is displaced by a plunger and seals the syringe body at the rear, and a separate container to be connected to the syringe and acting as the second chamber, which exhibits a locking cap with flanged cap incorporated in it, the objective set is achieved according to the invention in that the container acting as the second chamber, which incorporates the mixed component, exhibits an elastic locking cap with a centrically arranged weak point in the form of a diaphragm, and in that the flanged cap sealing the locking cap on the outside is provided with a means for centering, covering the same area and centering in relation to the weak point of the locking cap, so that when the container is installed the centering devices for the flanged cap and the rotating locking ring of the conical shoulder slot into each other so that they can be detached.

According to a further characteristic of the invention, it is provided that the elastic locking cap consists of rubber or plastic and is designed as a plug incorporating a hole which is sealed at the top by the weak point of the locking cap designed as a diaphragm.

The elastic locking cap, at the top, extends to advantage into a peripheral annular bead and on the bottom of the peripheral annular bead is provided with/without recesses running as far as the lower end and arranged so that they are distributed on the jacket side. The flanged cap is drilled centrically to act as a centering device for receiving the conical shoulder of the syringe body.

It is also provided that the diameter of the hole acting as a centering device is chosen smaller than the outside diameter of the locking ring on the conical shoulder. The locking ring can in this case be designed as a groove or raised around its periphery. As a centering device for receiving the conical shoulder of the syringe body, the flanged cap may also be provided with a centric weak point in the form of a diaphragm, instead of the hole.

Finally it should also be mentioned that the flanged cap consists of a light metal, e.g. aluminium, or of plastic. The separate container containing the mixed component and mounted on the syringe body, with elastic locking cap and flanged cap, consists of glass, transparent plastic or similar material, and is designed as a throw-away product.

The following description serves to explain the object of the invention, an embodiment of which is represented in the drawing, where:

Figure 1:
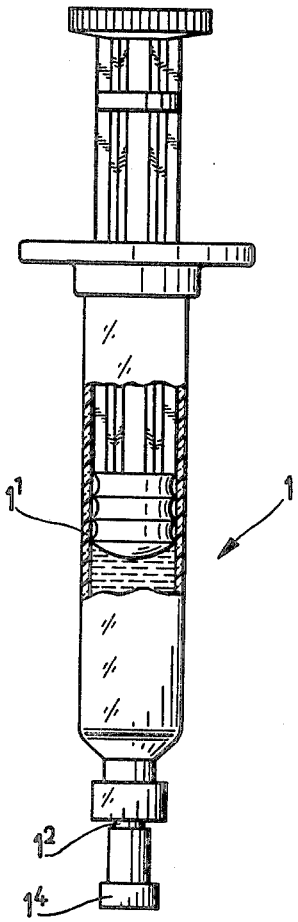
FIG. 1 shows an injection syringe with sealing cap fitted.
Figure 2:
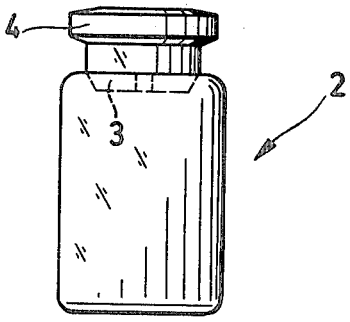
FIG. 2 shows a sealed container as the second chamber for the injection syringe.

The injection syringe 1 shown in FIG. 1, of known design, exhibits a syringe housing $\mathbf{1^1}$, containing an injection liquid which is to be mixed with a dry component before injection. The dry or second mixing component is located in a separate cylindrical container 2 of glass or transparent plastic (FIG. 2), which must be fitted for the mixing process on the conical shoulder $\mathbf{1^2}$ tightly inserted or flanged on to the lower part of the syringe housing $\mathbf{1^1}$ so that it can be detached and locked. For this purpose the sealing cap $\mathbf{1^4}$ mounted on the conical shoulder $\mathbf{1^2}$, which cap is locked by means of a raised, rotating ring $\mathbf{1^3}$ fitted on the conical shoulder $\mathbf{1^2}$, must be pulled off. The conical shoulder $\mathbf{1^2}$ also serves subsequently to receive the tubule or injection needle.

Both injection syringe 1 and the separate container 2 each form an enclosed unit until the twin-chamber syringe is used.

Figure 5:
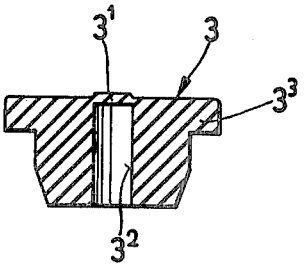
FIG. 5 shows a container locking cap in section.
Figure 6:
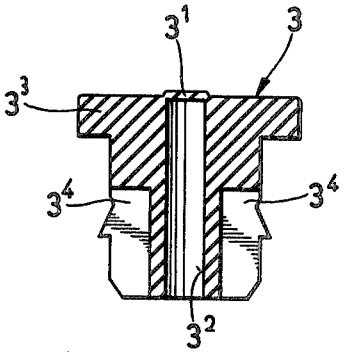
FIG. 6 shows a further embodiment of a locking cap in section.

The elastic sealing cap sealing the opening of container 2 (air-tight) is denoted by 3. The cap is provided on top with a centrically arranged weak point $\mathbf{3^1}$ in the form of a diaphragm (FIGS. 5 and 6). Locking cap 3 consists of rubber or plastic and is designed as a plug with hole $\mathbf{3^2}$, the hole $\mathbf{3^2}$ opening downwards terminating just below weak point $\mathbf{3^1}$. The diameter of the hole $\mathbf{3^2}$ is equal to the diameter of the tip of conical shoulder $\mathbf{1^2}$. On the top locking cap 3 runs out into an annular bead $\mathbf{3^3}$ sealing the container neck. Locking cap 3 may, for examle, exhibit the shape shown in FIGS. 5 and 6. The cap according to FIG. 6 consists of a plug which is to be used for containers 3 which receive freeze dried dry substance as the mixing component. For this purpose this locking cap 3 exhibits recesses $3^4$ arranged so that they run an far as the lower end and are distributed on the jacket side below the peripheral annular bead $3^3$ at a predetermined distance from it.

Figure 3:
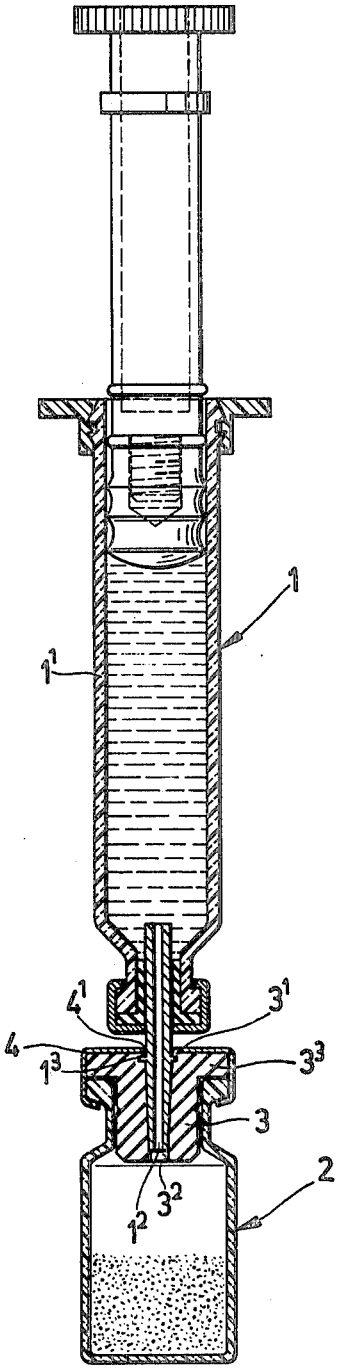
FIG. 3 shows the injection syringe with container fitted, in section, for use as a twin-chamber syringe.

FIG. 3 shown the injection syringe 1 (FIG. 1) with container 2 (FIG. 2) added to a detachable unit.

Figure 4:
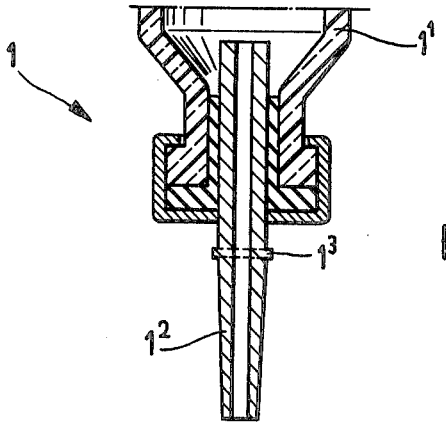
FIG. 4 shows an enlarged view of the lower part of the syringe body.

As also shown in FIG. 3, the elastic locking cap 3 placed on container 2 is firmly retained on the neck of container 2 by means of a flanged cap 4 on the outside so that it seals the neck. Flanged cap 4 may in this case be made from thin light metal, such as aluminium or of plastic, and exhibits a centering device in the form of a hole $4^1$, which covers the same area in relation to the position of the weak point $3^1$ of locking cap 3, for receiving the conical shoulder $1^2$. The diameter of hole $4^1$ is slightly smaller than the outside diameter of the locking ring $1^3$ already mentioned. (FIG. 4), i.e. the locking ring of conical shoulder $1^2$, so that the conical shoulder $1^2$ guided through hole $4^1$ is locked, so that it is subsequently detachable, after piercing the weak point $3^1$ of locking cap$^3$ designed as a diaphragm. The peripheral locking ring $1^3$ on conical shoulder $1^2$ may also be designed in the form of a groove.

Figure 7:
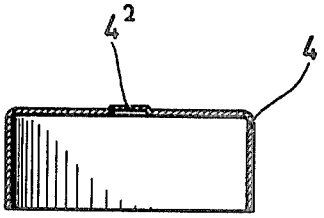
FIG. 7 shows a flanged cap in section for the container according to FIG. 2.

Furthermore, in a further developement of the invention according to FIG. 7, flanged cap 4 may also be provided with a prepressed, centric weak point $4^2$ instead of with a hole $4^1$ as the centering device for receiving conical shoulder $1^2$ of injection syringe 1. This weak point $4^2$ must then also be pierced like a diaphragm with conical shoulder $1^2$.

The twin-chamber syringe according to the invention is handled as follows:

The cylindrical container 2, which is sealed air-tight and filled with the solid or freeze dried mixing component, designed as the second chamber for injection syringe 1, is placed on conical shoulder $1^2$ of the injection syringe for subsequent use. Conical shoulder $1^2$ in this case pierces weak point $3^1$ in locking cap 3 and, if container 2 is provided with a flanged cap 4 without hole $4^1$ (FIG. 7), it also pierces the prepressed weak point $4^2$ of flanged cap 4 beforehand. Pierced conical shoulder $1^2$ and its locking ring $1^3$ engages with the hole edge on flanged cap 4. After conical shoulder $1^2$ has been fitted on, the injection liquid (first mixing component) in syringehousing $1^1$ is injected into container 2. The injection liquid is mixed with the dry component in container 2. The solution ready for injection is then sucked into the cylindrical syringe housing $1^1$ through the drilled conical shoulder $1^2$. The syringe is pulled off from container 2 and is ready for injection after the injection needle, not shown, has been placed on the conical shoulder. both injectionsyringe 1 and the separate container 2 to be connected to the syringe to form a detachable unit for use as a twin-chamber injection syringe, with elastic locking cap 3 and flanged cap 4, are designed as throw-away products which are also packed together. Container 2 according to the invention may be adapted as the second part of a twin-chamber syringe to practically every injection syringe provided with a conical shoulder.

I claim:

1. In a twin-chamber syringe for medical purposes, having a cylindrical syringe body with a conical shoulder on the front end, a peripheral rotating locking ring for firmly mounting a sealing cap or subsequently a tubule, a piston that can be displaced by means of a plunger and that seals the syringe body at the rear, and a separate container to be connected to the syringe, as the second chamber, and which has a sealing cap with a flanged cap incorporated in it, the improvement that said container serving as the second chamber, and which contains the mixing component, has an elastic locking cap with a centrically arranged weak point in the form of a diaphragm, and that said flanged cap sealing the locking cap on the outside, is provided with a centering device covering the same area as the weak point of the locking cap and receiving the conical shoulder, so that when container is fitted the centering device of the flanged cap and the peripheral locking ring of the conical shoulder snap into each other so that they can be subsequently detached.

2. A twin-chamber syringe, according to claim 1, wherein the elastic locking cap consists of rubber or plastic and is designed as a plug with a hole which is sealed on the top by the weak point of the locking cap designed as a diaphragm.

3. A twin-chamber syringe, according to claim 2, wherein the elastic locking cap extends on the upper side into a peripheral annular bead and is provided on the bottom of the peripheral annular bead with/without recesses arranged so that they run as far as the lower end and are distributed on the jacket side.

4. A twin-chamber syringe, according to claim 1, wherein as centering device for receiving the conical shoulder of the syringe body, the flanged cap is centrically drilled.

5. A twin-chamber syringe, according to claim 4, wherein the diameter of the hole acting as the centering device is smaller than the outside diameter of the locking ring on the conical shoulder.

6. A twin-chamber syringe, according to claim 5, wherein the locking ring on the conical shoulder is raised throughout its periphery.

7. A twin-chamber syringe, according to claim 1, wherein a centering device for receiving the conical shoulder of the syringe body, the flanged cap is provided with a central weak point in the form of a diaphragm.

8. A twin-chamber syringe, according to claim 7, wherein the flanged cap consists of light metal such as aluminium.

9. A twin-chamber syringe, according to claim 7, wherein the flanged cap consists of plastic.

10. A twin-chamber syringe, according to claim 9, wherein the separate container placed on the syringe body and containing the mixing component, with elastic locking cap and flanged cap, consists of glass, transparent plastic or similar material, and is designed as a throw-away product.

* * * * *